US010493473B2

(12) United States Patent
Joseph et al.

(10) Patent No.: US 10,493,473 B2
(45) Date of Patent: Dec. 3, 2019

(54) AIR CAPS WITH FACE GEOMETRY INSERTS FOR LIQUID SPRAY GUNS

(71) Applicant: 3M INNOVATIVE PROPERTIES COMPANY, St. Paul, MN (US)

(72) Inventors: Stephen C. P. Joseph, Woodbury, MN (US); John B. Scheibner, Woodbury, MN (US); Jameel R. Qiblawi, Mendota Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 664 days.

(21) Appl. No.: 14/904,234

(22) PCT Filed: Jul. 7, 2014

(86) PCT No.: PCT/US2014/045544

§ 371 (c)(1),
(2) Date: Jan. 11, 2016

(87) PCT Pub. No.: WO2015/009475

PCT Pub. Date: Jan. 22, 2015

(65) Prior Publication Data

US 2016/0151797 A1 Jun. 2, 2016

Related U.S. Application Data

(60) Provisional application No. 61/846,309, filed on Jul. 15, 2013.

(51) Int. Cl.
*B05B 7/08* (2006.01)
*B05B 7/06* (2006.01)

(52) U.S. Cl.
CPC ..... *B05B 7/0815* (2013.01); *B05B 7/066* (2013.01); *B05B 7/0861* (2013.01)

(58) Field of Classification Search
CPC ..... B05B 7/06; B05B 7/08; B05B 7/0815
(Continued)

(56) References Cited

U.S. PATENT DOCUMENTS 1,299,290 A 4/1919 Berg
1,539,536 A * 5/1925 Bartling ..... B05B 7/12 239/290

(Continued)

FOREIGN PATENT DOCUMENTS

CN 1280885 1/2001
CN 2431971 5/2001

(Continued)

OTHER PUBLICATIONS

Ihmels, Manfred, Ihmels Article—SATA, Feb. 15, 1989, 2 pages.

*Primary Examiner* — Viet Le

(57) ABSTRACT

Provided are air caps for liquid spray head assemblies and/or for liquid spray guns. Specifically provided are molded air caps with face geometry inserts. Face geometry inserts provided herein may be effective to provide refined spray patterns. The face geometry inserts are components that are self-aligning in that location, size, and spacing of air and/or liquid openings are designed into in a single piece. The air caps comprise a base member comprising: a base member body, at least one pair of exit air openings, a nozzle tip opening; and a face geometry insert comprising a pair of shaping air apertures and being retained to the base member body.

19 Claims, 9 Drawing Sheets

(58) Field of Classification Search
USPC ..... 239/290–301, 518, 526, 600, DIG. 14
See application file for complete search history.

(56) References Cited

U.S. PATENT DOCUMENTS 1,748,440 A * 2/1930 Burdick ..... B05B 7/2437 239/345
2,042,746 A * 6/1936 Tracy ..... B05B 7/045 239/300
2,059,706 A 11/1936 Paasche
2,126,888 A 8/1938 Jenkins
2,303,280 A * 11/1942 Jenkins ..... B05B 7/0815 239/296
2,362,946 A 11/1944 Stockdale
2,497,625 A 2/1950 Norwick
2,820,670 A 1/1958 Charlop
2,886,252 A 5/1959 Ehrensperger
2,904,262 A 9/1959 Peeps
2,991,940 A * 7/1961 Dupler ..... B05B 9/01 239/125
3,062,453 A 11/1962 Matthews
3,157,360 A 11/1964 Heard
3,168,250 A * 2/1965 Paasche ..... B05B 7/066 239/300
3,236,459 A 2/1966 McRitchie
3,270,920 A 9/1966 Nessler
3,515,354 A 6/1970 Presson
3,581,998 A 6/1971 Roche
3,623,669 A 11/1971 Woods
3,633,828 A 1/1972 Larson
3,876,150 A 4/1975 Dwyer
3,942,680 A 3/1976 Seeley
4,160,525 A 7/1979 Wagner
4,392,617 A 7/1983 Bakos
4,403,738 A 9/1983 Kern
4,478,370 A * 10/1984 Hastings ..... B05B 5/03 239/707
4,513,913 A 4/1985 Smith
4,529,126 A 7/1985 Ives
4,537,357 A 8/1985 Culbertson
4,562,965 A 1/1986 Ihmels
4,615,485 A 10/1986 Larson
4,657,184 A 4/1987 Weinstein
4,660,774 A 4/1987 Kwok
4,712,739 A 12/1987 Bihn
4,760,962 A 8/1988 Wheeler
4,811,904 A 3/1989 Ihmels
4,815,666 A 3/1989 Gacka
4,817,872 A 4/1989 Mattson
4,830,281 A 5/1989 Calder
4,925,101 A 5/1990 Konieczynski
4,971,251 A 11/1990 Dobrick
4,993,642 A 2/1991 Hufgard
5,022,590 A 6/1991 Buschor
5,110,011 A 5/1992 Laska
5,119,992 A 6/1992 Grime
5,152,460 A 10/1992 Barty
5,178,330 A 1/1993 Rodgers
5,242,115 A 9/1993 Brown
5,279,461 A * 1/1994 Darroch ..... B05B 7/0081 239/290
5,280,853 A 1/1994 Perret
5,322,221 A 6/1994 Anderson
5,332,156 A 7/1994 Wheeler
5,344,078 A * 9/1994 Fritz ..... B05B 7/0081 239/290
5,395,046 A 3/1995 Knobbe
5,435,491 A * 7/1995 Sakuma ..... B05B 7/0815 239/296
5,454,517 A 10/1995 Naemura
5,456,414 A 10/1995 Burns
5,474,450 A 12/1995 Chronister
5,582,350 A 12/1996 Kosmyna
5,607,108 A 3/1997 Garlick
5,609,302 A 3/1997 Smith
5,613,637 A 3/1997 Schmon
5,711,421 A 1/1998 Guo
5,765,753 A 6/1998 Kieffer
5,875,971 A 3/1999 Morck
5,961,050 A 10/1999 Kitajima
5,979,797 A 11/1999 Castellano
6,012,651 A 1/2000 Spitznagel
6,019,294 A 2/2000 Anderson
6,050,504 A * 4/2000 Schultz ..... B05B 7/0475 239/327
6,056,213 A 5/2000 Ruta
6,068,203 A 5/2000 DeYoung
6,085,996 A 7/2000 Culbertson
D429,794 S 8/2000 Beaver
6,098,902 A 8/2000 Culbertson
6,105,881 A 8/2000 Kitajima
6,254,015 B1 7/2001 Abplanalp
6,345,776 B1 2/2002 Hurray
6,375,096 B1 4/2002 Rashidi
6,425,536 B2 7/2002 Namura
6,450,422 B1 9/2002 Maggio
6,460,787 B1 10/2002 Hartle
6,471,144 B1 10/2002 Huang
6,494,387 B1 12/2002 Kaneko
6,502,763 B1 1/2003 McCann
6,536,687 B1 3/2003 Navis
6,543,705 B1 4/2003 Liao
6,601,782 B1 8/2003 Sandholm
6,685,106 B1 2/2004 Van der Steur
6,702,198 B2 3/2004 Tam
6,719,212 B1 4/2004 Leisi
6,749,132 B2 6/2004 Pettit
6,793,155 B2 9/2004 Huang
6,805,306 B1 10/2004 Huang
6,808,122 B2 10/2004 Mitcheli
6,820,824 B1 11/2004 Joseph
6,854,667 B2 2/2005 Ulrich
6,860,438 B1 3/2005 Huang
6,874,702 B2 4/2005 Turnbull
6,935,577 B2 8/2005 Strong
6,953,155 B2 10/2005 Joseph
6,971,590 B2 12/2005 Blette
7,032,839 B2 4/2006 Blette
7,083,119 B2 8/2006 Bouic
7,097,118 B1 8/2006 Huang
7,165,732 B2 1/2007 Kosmyna
D538,886 S 3/2007 Huang
7,201,336 B2 4/2007 Blette
D542,375 S 5/2007 Blette
D542,376 S 5/2007 Blette
7,237,727 B2 7/2007 Wang
7,246,759 B2 7/2007 Turnbull
D548,816 S 8/2007 Schmon
7,328,855 B2 2/2008 Chatron
RE40,433 E * 7/2008 Schmon ..... B05B 7/1209 239/296
D572,343 S 7/2008 Huang
7,484,676 B2 2/2009 Joseph
7,513,443 B2 4/2009 Escoto, Jr.
7,661,606 B2 * 2/2010 Vacher ..... B05B 7/0815 239/296
7,694,896 B2 4/2010 Turnbull
D616,527 S * 5/2010 Anderson ..... D23/226
7,712,682 B2 5/2010 Joseph
7,757,972 B2 7/2010 Kosmyna
7,789,324 B2 9/2010 Bouic
7,789,327 B2 9/2010 Micheli
7,798,061 B2 9/2010 Dilou
7,891,588 B2 2/2011 Jones
7,922,107 B2 4/2011 Fox
7,946,510 B2 5/2011 Huang
7,971,806 B2 7/2011 Johnson
8,066,205 B2 11/2011 Bass
8,297,536 B2 10/2012 Ruda
8,313,047 B2 11/2012 Micheli
8,360,345 B2 1/2013 Micheli
8,500,043 B2 8/2013 Heigl
8,590,809 B2 11/2013 Escoto, Jr.
8,684,281 B2 4/2014 Micheli

(56) References Cited

U.S. PATENT DOCUMENTS

| | | | | |
|---|---|---|---|---|
| 8,807,454 | B2 * | 8/2014 | Reitz | B05B 7/0815 239/296 |
| 8,991,721 | B2 * | 3/2015 | Bedetti | B01J 2/16 239/429 |
| 9,302,278 | B2 * | 4/2016 | Huang | B05B 1/042 |
| 9,358,561 | B2 * | 6/2016 | Johnson | B05B 7/066 |
| D798,419 | S * | 9/2017 | Gehrung | D23/226 |
| 9,751,100 | B2 * | 9/2017 | Joseph | B05B 7/067 |
| 9,782,784 | B2 * | 10/2017 | Schmon | B05B 7/064 |
| 9,802,211 | B2 * | 10/2017 | Joseph | B05B 7/02 |
| 9,802,213 | B2 * | 10/2017 | Joseph | B05B 7/2432 |
| 2001/0032891 | A1 * | 10/2001 | Huffman | B05B 1/3046 239/296 |
| 2002/0104898 | A1 | 8/2002 | Bonnique | |
| 2003/0015604 | A1 * | 1/2003 | Kobayashi | B05B 7/0815 239/299 |
| 2003/0025000 | A1 * | 2/2003 | Schmon | B05B 12/008 239/296 |
| 2003/0066905 | A1 * | 4/2003 | Huffman | B05B 7/1673 239/135 |
| 2003/0071144 | A1 | 4/2003 | Naemura | |
| 2003/0111553 | A1 | 6/2003 | Hunter | |
| 2003/0173419 | A1 * | 9/2003 | Huang | B05B 7/066 239/296 |
| 2004/0046040 | A1 * | 3/2004 | Micheli | B05B 1/26 239/11 |
| 2004/0089742 | A1 | 5/2004 | Antonucci | |
| 2004/0140373 | A1 | 7/2004 | Joseph | |
| 2004/0195401 | A1 | 10/2004 | Strong | |
| 2004/0245673 | A1 | 12/2004 | Allsop | |
| 2004/0256484 | A1 | 12/2004 | Joseph | |
| 2004/0256493 | A1 | 12/2004 | Turnbull | |
| 2005/0001060 | A1 * | 1/2005 | Robinson | B05B 7/066 239/291 |
| 2005/0016448 | A1 | 1/2005 | Dilou | |
| 2005/0035220 | A1 | 2/2005 | Brown | |
| 2005/0045741 | A1 | 3/2005 | Brown | |
| 2005/0087128 | A1 | 4/2005 | Jakupovic | |
| 2005/0145724 | A1 | 7/2005 | Blette | |
| 2005/0173561 | A1 | 8/2005 | Cotter | |
| 2005/0242207 | A1 * | 11/2005 | Tejeda | B05B 7/066 239/346 |
| 2006/0000927 | A1 | 1/2006 | Ruda | |
| 2006/0016909 | A1 * | 1/2006 | Liu | B05B 7/066 239/296 |
| 2006/0065761 | A1 | 3/2006 | Joseph | |
| 2006/0097070 | A1 * | 5/2006 | Huffman | B05B 7/066 239/290 |
| 2006/0102550 | A1 | 5/2006 | Joseph | |
| 2006/0175433 | A1 | 8/2006 | Escoto, Jr. | |
| 2006/0186223 | A1 | 8/2006 | Wang | |
| 2006/0202060 | A1 * | 9/2006 | Alexander | B05B 7/0815 239/525 |
| 2007/0102535 | A1 | 5/2007 | Carey | |
| 2007/0262169 | A1 | 11/2007 | Wang | |
| 2007/0262172 | A1 | 11/2007 | Huffman | |
| 2008/0078849 | A1 | 4/2008 | Fox | |
| 2008/0093479 | A1 | 4/2008 | Delbridge | |
| 2008/0251606 | A1 * | 10/2008 | Bloom | B05B 7/0815 239/265.19 |
| 2008/0272213 | A1 | 11/2008 | Ting | |
| 2009/0026288 | A1 * | 1/2009 | Shih | B05B 7/066 239/296 |
| 2009/0026290 | A1 | 1/2009 | Fox | |
| 2009/0121048 | A1 | 5/2009 | Noshima | |
| 2009/0302133 | A1 | 12/2009 | Micheli | |
| 2010/0108783 | A1 | 5/2010 | Joseph | |
| 2010/0123024 | A1 | 5/2010 | Gohring | |
| 2010/0133358 | A1 | 6/2010 | Goehring | |
| 2010/0187333 | A1 | 7/2010 | Escoto, Jr. | |
| 2010/0282868 | A1 | 11/2010 | Heigl | |
| 2011/0168811 | A1 | 7/2011 | Fox | |
| 2013/0056556 | A1 * | 3/2013 | Schmon | B05B 7/064 239/296 |
| 2013/0092760 | A1 | 4/2013 | Joseph | |
| 2013/0327850 | A1 | 12/2013 | Joseph | |
| 2014/0014741 | A1 | 1/2014 | Escoto | |
| 2014/0246519 | A1 | 9/2014 | Johnson | |
| 2015/0028131 | A1 | 1/2015 | Joseph | |

FOREIGN PATENT DOCUMENTS

| | | |
|---|---|---|
| CN | 1827231 | 9/2006 |
| DE | 3815327 | 11/1989 |
| DE | 4027421 | 3/1992 |
| DE | 4302911 | 8/1993 |
| DE | 19503495 | 8/1996 |
| DE | 19605227 | 8/1997 |
| DE | 10315426 | 6/2004 |
| DE | 60005536 | 7/2004 |
| DE | 102004027789 | 2/2005 |
| DE | 102004044475 | 12/2005 |
| DE | 102007012989 | 10/2007 |
| DE | 202011050102 | 9/2011 |
| EP | 279992 | 8/1988 |
| EP | 509367 | 10/1992 |
| EP | 0492333 | 3/1995 |
| EP | 0885658 | 12/1998 |
| EP | 1340550 | 9/2003 |
| EP | 1479447 | 11/2004 |
| EP | 1554051 | 4/2006 |
| EP | 1682231 | 7/2006 |
| EP | 1699565 | 6/2008 |
| EP | 1964616 | 9/2008 |
| EP | 2108460 | 10/2009 |
| EP | 2386360 | 11/2011 |
| EP | 2486985 | 8/2012 |
| GB | 425382 | 9/1934 |
| GB | 829370 | 3/1960 |
| GB | 1231041 | 5/1971 |
| GB | 1293341 | 10/1972 |
| GB | 1338099 | 11/1973 |
| JP | 63-39448 | 3/1988 |
| JP | H07-265751 | 10/1995 |
| JP | H1028906 | 2/1998 |
| JP | 11-114458 | 4/1999 |
| JP | 20021169 | 1/2002 |
| JP | 2003112086 | 4/2003 |
| JP | 2005211699 | 8/2005 |
| JP | 2007175650 | 7/2007 |
| KR | 10-0435685 | 6/2004 |
| KR | 20-0428831 | 10/2006 |
| NL | 1024774 | 3/2004 |
| RU | 2014906 | 6/1994 |
| SU | 172206 | 1/1965 |
| WO | WO 03/051524 | 6/2003 |
| WO | WO 2004/037432 | 5/2004 |
| WO | WO 2004/037433 | 5/2004 |
| WO | WO 2004/087332 | 10/2004 |
| WO | WO 2005/049145 | 6/2005 |
| WO | WO 2005/063361 | 7/2005 |
| WO | WO 2006/053229 | 5/2006 |
| WO | WO 2006/098623 | 9/2006 |
| WO | WO 2006/107935 | 10/2006 |
| WO | WO 2007/056589 | 5/2007 |
| WO | WO 2007/104967 | 9/2007 |
| WO | WO 2007/139639 | 12/2007 |
| WO | WO 2008/016557 | 2/2008 |
| WO | WO 2012/109298 | 8/2012 |
| WO | WO 2013/016474 | 1/2013 |
| WO | WO 2013/055730 | 4/2013 |

* cited by examiner

AIR CAPS WITH FACE GEOMETRY INSERTS FOR LIQUID SPRAY GUNS

CROSS REFERENCE TO RELATED APPLICATIONS

This application is a national stage filing under 35 U.S.C. 371 of PCT/US2014/045544, filed Jul. 7, 2014, which claims priority to U.S. Provisional Application No. 61/846,309, filed Jul. 15, 2013, the disclosures of which are incorporated by reference in their entireties herein.

TECHNICAL FIELD

This disclosure relates to air caps for liquid spray head assemblies and/or for liquid spray guns. Specifically provided are molded air caps with face geometry inserts. Face geometry inserts provided herein may be effective to provide symmetrical and balanced spray patterns.

BACKGROUND

Spray guns are known for use in the application of liquids such as paints (and other coatings) across many industries. Such spray guns commonly include a gun body, a trigger, a spray head assembly, a reservoir for holding a liquid to be sprayed, and an air source to assist in atomizing and propelling the liquid onto a surface to be coated. During use, the liquid may accumulate on the exterior and interior surfaces of the spray guns. Historically, spray guns were fabricated from metal and for a long-use life, which included reuse after cleaning and/or maintenance. Development of individual molded parts having a limited-use life for spray guns, including but not limited to, nozzles tips, air horns, and/or air caps, permits certain parts of spray guns to be easily cleaned and/or disposable to alleviate and/or mitigate the extensive use of cleaning chemicals and maintenance typically needed for metal or long-use components. These individual parts may contain air and/or liquid openings and alignment among the individual parts impacts a resulting spray pattern.

There is an on-going need for improved molded parts to reduce manufacturing costs, to increase precision in the fabricated parts, and to ensure desired performance of the spray guns.

SUMMARY

In order to address ensuring individual parts fabricated for spray guns are aligned to deliver desired spray patterns, face geometry inserts have been developed. Specifically provided herein are molded air caps with face geometry inserts for use with liquid spray head assemblies and/or for liquid spray guns.

In a first aspect, provided are air caps for a liquid spray gun, the air caps comprising: a base member comprising: a base member body, at least one pair of exit air openings, and a nozzle tip opening; and a face geometry insert comprising a bridging portion and a pair of shaping air apertures and being retained to the base member body; wherein each aperture of the pair of shaping air apertures is located on an opposite side of a spray axis of the air cap.

Other features that may be used individually or in combination are as follows. Each aperture of the pair of shaping air apertures may be symmetric with respect to the spray axis. The face geometry insert may further comprise a center frame opening such that the center frame opening is concentric with the nozzle tip opening. The face geometry insert may further comprise at least one pair of capping features. The base member may further comprise at least one pair of capping features. The face geometry insert may further comprise at least one pair of auxiliary air holes. The base member may further comprise at least one pair of air horns that have the at least one pair of exit air openings. The face geometry insert may comprise at least one hinge. Or, the face geometry insert may comprise a non-planar body and no hinges.

In one or more of the disclosed embodiments, the face geometry insert is removable from the base member body. For example, the face geometry insert may snap-fit into the base member body. Or, the face geometry insert may bend-fit into the base member body.

In other disclosed embodiments, the face geometry insert is welded to the base member body.

All embodiments may further comprise a nozzle tip affixed to the face geometry insert. The nozzle tip may be removably affixed to the center frame of the face geometry insert. Or, the nozzle tip may be integral to the face geometry insert.

An included angle $\Theta$ with respect to the relation among the spray axis and a plane of each surface of the pair of shaping air apertures is in the range of 25° to 85°.

Another aspect provides a kit comprising a plurality of air caps as disclosed herein with one or more features of various sizes. For example, the pairs of shaping air apertures of at least two of the face geometry inserts may have different configurations and/or the center frame openings of at least two of the face geometry inserts may have different dimensions and/or nozzle tips of different dimensions may be included.

Further aspects provide a method of making an air cap, the method comprising: providing a face geometry insert comprising a bridging portion and a pair of shaping air apertures; providing a base member; and assembling the face geometry insert with the base member to form the air cap such that each aperture of the pair of shaping air apertures is located on an opposite side of a spray axis of the air cap. The face geometry insert may be fabricated by molding or stamping. The face geometry insert may be moved from an initial position to an assembled position upon assembly with the base member. The face geometry insert and the base member independently comprise a metal, a polymer, a ceramic, a filled material, or combinations thereof.

Another aspect is a spray head assembly for attachment to a liquid spray gun, the spray head assembly comprising a barrel and any of the air caps disclosed herein along with a nozzle tip.

Liquid spray guns are also provided, which comprise: spray head assembly as disclosed herein assembled with a liquid spray gun body.

These and other aspects of the invention are described in the detailed description below. In no event should the above summary be construed as a limitation on the claimed subject matter.

BRIEF DESCRIPTION OF THE DRAWINGS

The accompanying drawings are included to provide a further understanding of the invention described herein and are incorporated in and constitute a part of this specification. The drawings illustrate exemplary embodiments. Certain features may be better understood by reference to the following detailed description when considered in connection with the accompanying drawings, in which like reference numerals designate like parts throughout the figures thereof, and wherein.

The figures are not necessarily to scale. Like numbers used in the figures refer to like components. It will be understood, however, that the use of a number to refer to a component in a given figure is not intended to limit the component in another figure labeled with the same number.

DETAILED DESCRIPTION

Figure 1:
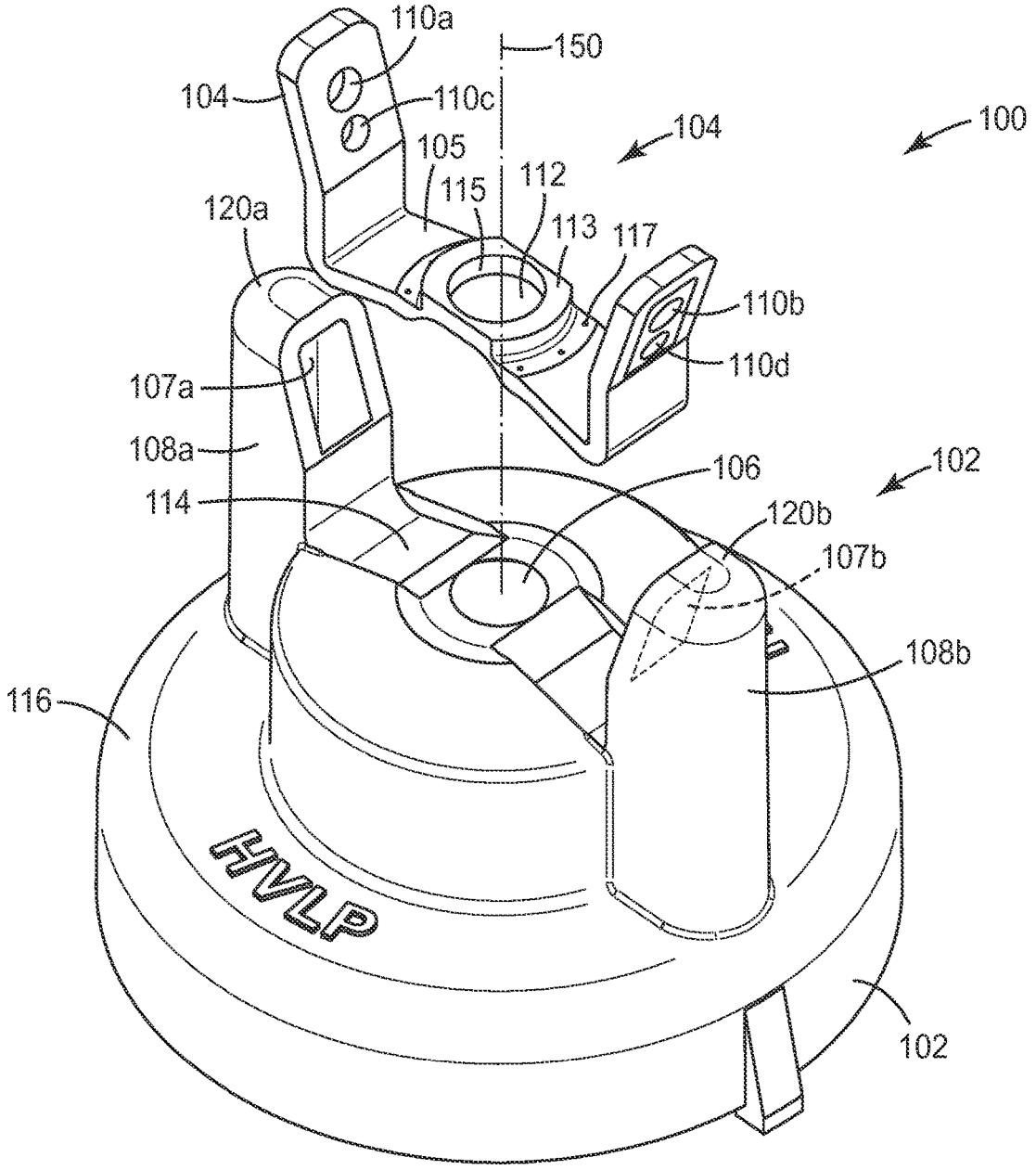
FIG. 1 is an exploded perspective view of an air cap according to an embodiment.

Provided are air caps for liquid spray head assemblies and/or for liquid spray guns. Specifically provided are molded air caps with face geometry inserts. Face geometry inserts provided herein are effective to provide a refined spray pattern, which is a spray pattern suitable for a desired application that is balanced, symmetrical, and has smooth transitions in coating spray density within the pattern. For smooth transitions, there are no excessively sharp changes in coating amount/density. When components for liquid spray guns are fabricated from metal, current methods used to manufacture these components may involve casting or machining where creating pathways for air and/or liquid flow, and in particular for atomization, usually requires using labor and/or capitol intensive secondary operations, such as precision drilling. The secondary operations are susceptible to variations in the size and positioning of critical air outlets. Moreover, with machining, certain geometries simply cannot be achieved due to the inability of drilling tools to reach all surfaces and desired angles. Even with molded components, both one-part and two-part, there are inefficiencies in fabrication and imprecise methods that could be improved. Shrinkage and distortion of molded parts, in view of, for example, design and wall thickness, can cause misalignment and part-to-part variation. Face geometry inserts, as described herein are beneficial in alleviating shortcomings in the prior art.

Through the use of the inventive face geometry inserts, designs of molded components for liquid spray guns are simplified and made more precise. Specifically, the face geometry inserts are components wherein the location, size, and spacing of critical air and/or liquid openings are already aligned/designed into a single piece A face geometry insert is retained to a base member to form an air cap. The base member may be the larger of the two pieces, and it is fabricated easily as one piece without a need for precisely aligned features, such as primary/shaping air apertures/holes. The face geometry insert may be the smaller of the two pieces and its manufacture and the features therein may be precisely controlled with minimal variation in dimensions that are critical to correct operation. The base member may be fabricated as needed, as one part or a combination of parts.

In this way, the design/fabrication of air caps is simplified. Benefits include greater and improved control of positioning and size of paint atomization and pattern formation features. Face geometry inserts may be color-coded with base members and/or barrels for quick recognition of material/job specified combinations. The face geometry inserts described herein can be designed to achieve a variety of patterns as desired. Indeed, customized face geometry inserts may be combined (assembled) with a universal base member body in order to create a wide range of air cap configurations.

Generally, spray patterns are produced by liquid exiting a liquid nozzle port (also referred to as a fluid tip) of a barrel/nozzle, the port being centrally located within the center hole of an air cap and as such is surrounded by a center annular air outlet that channels compressed air and a pair of opposed inwardly directed shaping air apertures that also channel compressed air arranged on opposite sides and spaced forwardly of the center annular air outlet. In this way, the liquid emerging from the liquid nozzle port is mixed with air streams emerging from the center air outlet and from the inwardly directed shaping air apertures, which causes the liquid to atomize and form a spray for application to a substrate. Air streams or jets from the shaping air apertures may be adjustable to adapt the spray nozzle for dispensing different liquids and/or change the geometry of the spray pattern. Air streams from the auxiliary air holes in the air cap may further atomize the liquid and/or interact with the shaping air streams to further refine the spray pattern.

Face geometry inserts and base members may be fabricated by molding or stamping or other methods related to manipulating/processing plastics and/or metals known in the art. They may be fabricated in the same way or differently, by the same materials or different ones. In one or more embodiments, the fabrication methods include introducing first and second materials in their molten state to first and second molds, respectively, to create formed molten materials, and then cooling the formed molten materials. Suitable materials independently include, but are not limited to, metals, polymers, ceramics, and other materials such as glass, filled-materials, and ceramics.

Suitable metals include, but are not limited to, aluminum, copper, or steel, including combinations and/or alloys thereof. Suitable polymers independently include, but are not limited to, polyurethanes, polyolefins (e.g., polypropylenes), polyamides (e.g., nylons including amorphous nylons), polyesters, fluoropolymers, and polycarbonates), and others. The polymers may be opaque, translucent, or transparent as suitable for the application. Exemplary filled-material is glass-filled polypropylene. The molds can be designed with features, such as steel core pins that form resulting openings in the molded parts, the openings including but not being limited to shaping air apertures, auxiliary air holes, and center frame openings, and overall geometries as desired. In one or more embodiments, the face geometry insert is formed in one-step, including formation of its openings. In other embodiments, openings may be drilled, for example by laser drilling, in a separate step, Face geometry inserts may contain other features as desired to direct air.

Face geometry inserts may also be fabricated by stamping, for example by metal stamping. In addition, photolithographic methods that involve additive processes like metal plating and/or subtractive processes like chemical etching may be suitable for forming face geometry inserts and/or their features.

The face geometry insert may be changeable, flexible, and/or deformable as needed to permit it to go from an initial position to an assembled position upon assembly with or fitting into the base member. By "flex" it is contemplated that the face geometry insert is sufficiently flexible to bend over a least some portion of its length and is sufficient to achieve an included angle between shaping air streams of up to 85 degrees. That is, materials of construction have adequate elasticity and/or plasticity to allow change from an initial position to an assembled position. Also, the presence of hinges may facilitate assembly of the face geometry insert with the base member or the ability to deliberately distort the face geometry insert from its initial position, which is an unassembled configuration, into an assembled configuration by bending the face geometry insert at one or two or more predefined locations.

The face geometry insert may be snap-fit, bend-fit, welded, bonded, or otherwise retained to a base member such that a substantially tight seal is achieved. The seal may be air tight, or it may tolerate some venting. In this way, air exits the air caps through designed openings, including but not limited to a nozzle tip opening, shaping air apertures, and optional auxiliary air holes. The face geometry insert may, for example, be snap-fit onto or into the top side or underside of the base member. With snap-fit assembly, the face geometry insert may be removable; with welding, the face geometry insert usually is not removable. For welding, one method is ultrasonics, where an energy director may be present to ensure that the parts are correctly adhered to one another.

The base member may have one or more receiving features such as a slight recess, groove, and/or other locating feature that cooperates with the face geometry insert. With respect to aligning and registering parts, the face geometry insert, with its openings pre-designed and already precisely aligned onto a single piece, receipt into the base member ensures that the registration continues to be maintained upon assembly.

In one or more embodiments, the face geometry insert is removable from the base member. In one or more other embodiments, the face geometry insert is non-removable.

The face geometry insert may be shaped as needed, for example, an elongated body may be suitable when the air cap design includes a structure for exit air openings such as air horns. In other embodiments, the body of the face geometry insert may be disc-shaped, circular, oval, or even square. The face geometry insert comprises openings located in a bridging portion, which means the bridging portion is the material between the various openings including but not limited to shaping air apertures. The face geometry insert may contain as many openings or pairs of openings as needed. Some embodiments provide 2, 3, 4, 5, or more openings. It is understood that a base member of the air cap will be configured to deliver air as needed to the openings of the face geometry insert. The exit air openings may be formed, for example, through a surface of the body of the base member. An exit air structure, such as at least one pair of air horns, may be attached to or received by or integral with the base member body.

Before describing several exemplary embodiments of the invention, it is to be understood that the invention is not limited to the details of construction or process steps set forth in the following description. The invention is capable of other embodiments and of being practiced or being carried out in various ways.

Turning to FIG. 1, which is an exploded perspective view of an air cap according to an embodiment, an air cap 100 comprises a base member 102 and a face geometry insert 104. In the embodiment of FIG. 1, the face geometry insert 104 comprises a bridging portion 105, one or more pairs of shaping air apertures 110*a*, 110*b* and 110*c*, 110*d* and is retained to the base member 102. The face geometry insert 104 may also comprise a center frame 113 and a center frame opening 112. Air flow surface 115 defines how air flows through the center frame opening 112. Upon assembly with into a spray head assembly, a liquid nozzle port will reside within and preferably concentrically with the center frame opening 112. As will be discussed with respect to FIGS. 11-13, air will flow through the annulus formed between the air flow surface 115 (315, 415) and the outside diameter of the liquid nozzle port (352, 452). The air flow surface 115 may be designed in any angle, depth, shape, or otherwise to achieve a spray pattern suitable for a particular application. Upon assembly with a liquid spray gun, positioning of the pair of shaping air apertures and the center frame opening is effective to provide a refined spray pattern from the liquid spray gun.

Optional auxiliary air holes 117 may be formed in the face geometry insert 104. The base member 102 is configured as needed to supply/channel air to the auxiliary air holes 117 in the face member insert 104.

The base member 102 comprises at least one pair of exit air openings 107*a*, 107*b*, a base member body 116, and a nozzle tip opening 106. The exit air openings in this embodiment are formed through an exit air structure, such as at least one pair of air horns 108*a*, 108*b* as exemplified in FIG. 1. The base member may further comprise a receiving feature 114 for receiving the face geometry insert 104. The base member 102 may optionally further comprise one or more capping features 120*a*, 120*b* to facilitate affixing and/or registering the face geometry insert 104 to base member 102. While the embodiment of FIG. 1 shows the capping features 120*a*, 120*b* as part of the air horns 108*a*, 108*b*, respectively, the capping features may be located elsewhere as the design permits. The center frame opening 112 of the face geometry insert 104 may be axially and/or concentrically aligned with the nozzle tip opening 106. Both openings may be independently shaped as desired. In some embodiments the openings are independently circular or oval, or indeed other alternative shapes and/or geometries.

A spray axis 150 extends through the center of the nozzle tip opening 106 and the center frame opening 112. When a liquid nozzle port is present, the spray axis extends through the liquid nozzle port center also. Upon centering of air and/or liquid openings about the spray axis 150, alignment of air and/or liquid flow and/or symmetry of the spray pattern is achieved. As shown, each aperture of the pair of shaping air apertures is located on an opposite side of the spray axis 150. That is, shaping air aperture 110*a* is on an opposite side of spray axis 150 as compared to shaping air aperture 110*b*. Likewise, shaping air aperture 110*c* is on an opposite side of spray axis 150 as compared to shaping air aperture 110*d*. In one or more embodiments, the shaping air apertures 110*a*, 110*b* and/or 110*c*, 110*d* are symmetric with respect to the spray axis 150.

Figure 2:
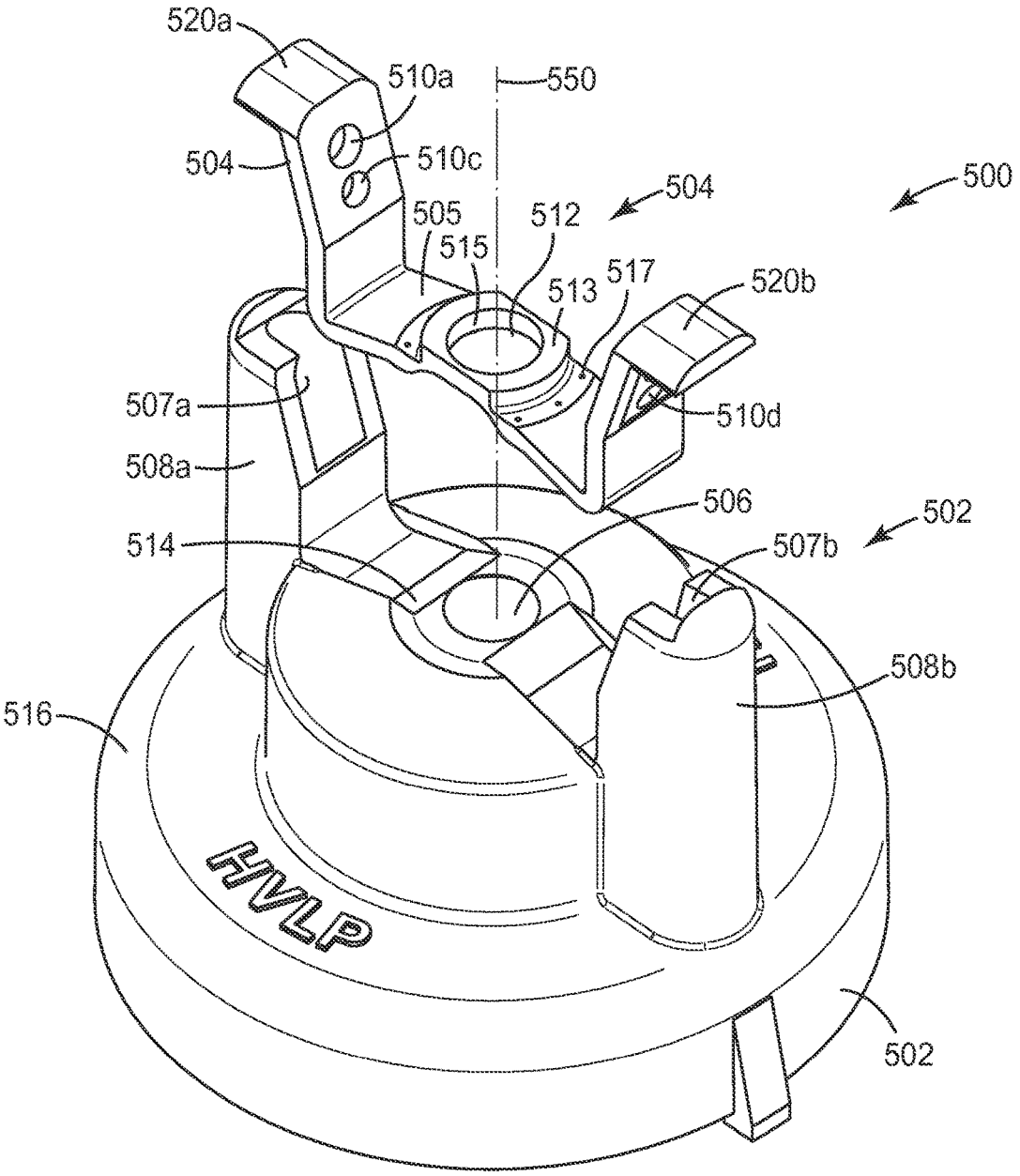
FIG. 2 is an exploded perspective view of an air cap according to another embodiment.
Figure 3:
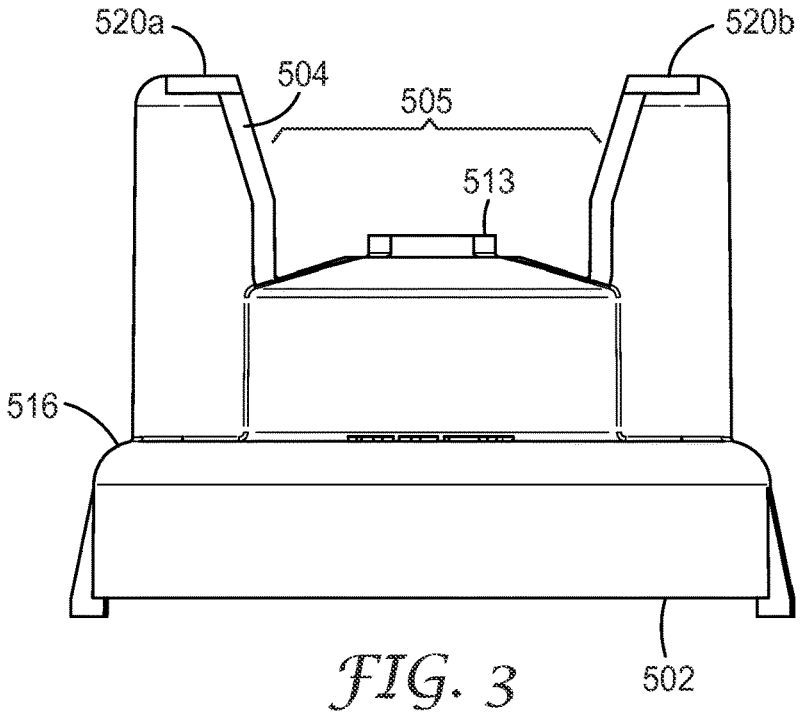
FIG. 3 is a side view of the air cap of FIG. 2.
Figure 4:
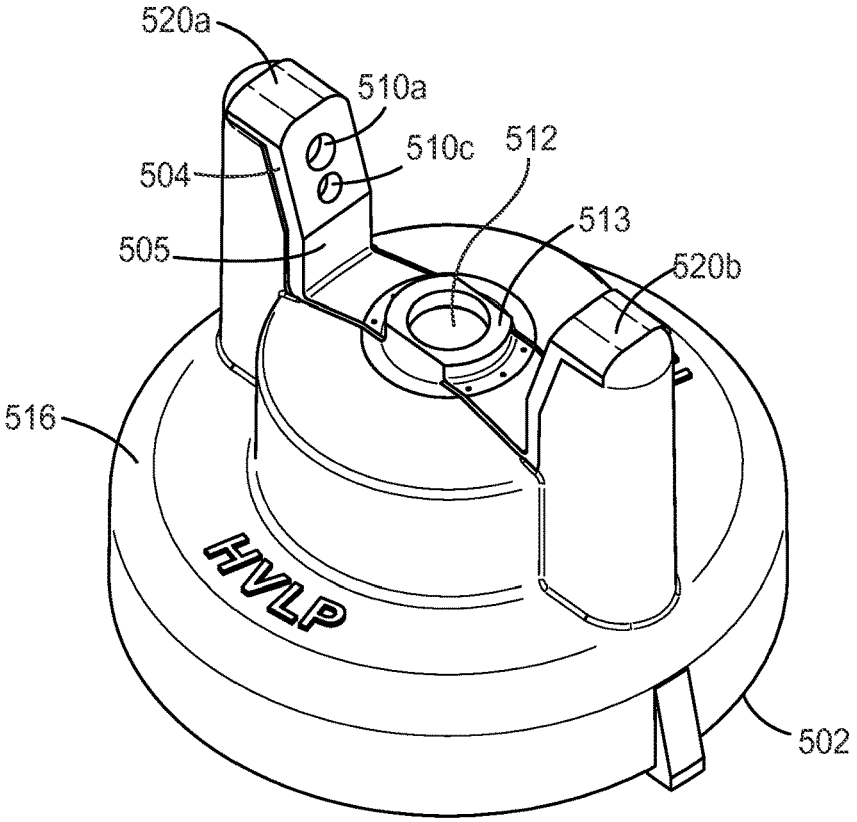
FIG. 4 is a perspective view of the air cap of FIG. 2.

In one or more embodiments, pairs of apertures 110*a*, 110*b* and 110*c*, 110*d* are symmetric with respect to the spray axis 150. In FIG. 2, which is an exploded perspective view of an air cap according to another embodiment; FIG. 3, which is a side view; FIG. 4, which is a perspective view; and FIG. 5, which is a cross-section view; the air cap 500 comprises a base member 502 and a face geometry insert 504. In the embodiment of FIG. 2, the capping features 520*a*, 520*b* are part of the face geometry insert 504. The face geometry insert 504 also comprises a bridging portion 505 and one or more pairs of shaping air apertures 510*a*, 510*b* and 510*c*, 510*d* and is retained to the base member 502. The face geometry insert 504 may also comprise a center frame 513 and a center frame opening 512. Air flow surface 515 defines how air flows through the center frame opening 512. Upon assembly with into a spray gun assembly, a liquid nozzle port will reside in the center frame opening 512. Air will flow through the annulus formed between the air flow surface 515 and the outside diameter of the liquid nozzle port. The air flow surface 515 may be designed in any angle, depth, shape, or otherwise overall geometry to achieve a spray pattern suitable for a particular application. Upon assembly with a liquid spray gun, positioning of the pair of shaping air apertures and the center frame opening is effective to provide a symmetrical spray pattern from the liquid spray gun.

The base member 502 comprises at least one pair of exit air openings 507*a*, 507*b*, a base member body 516, and a nozzle tip opening 506. The base member may further comprise a receiving feature 514 for receiving the face geometry insert 504. The center frame opening 512 of the face geometry insert 504 may be axially and/or concentrically with the nozzle tip opening 506. Both openings may be independently shaped as desired. In some embodiments the openings are independently circular or oval or non-circular.

A spray axis 550 extends through the center of the nozzle tip opening 506 and the center frame opening 512. When a liquid nozzle tip is present, the spray axis extends through the center of the liquid nozzle port also. Upon centering of air and/or liquid openings about the spray axis 550, alignment of air and/or liquid flow and/or symmetry of the spray pattern is achieved. As shown, each aperture of the pair of shaping air apertures is located on an opposite side of the spray axis 550. That is, shaping air aperture 510*a* is on an opposite side of spray axis 550 as compared to shaping air aperture 510*b*. Likewise, shaping air aperture 510*c* is on an opposite side of spray axis 150 as compared to shaping air aperture 510*d*. In one or more embodiments, the air apertures 510*a*, 510*b* and/or 510*c*, 510*d* are symmetric with respect to the spray axis 550.

In one or more embodiments, the pair of apertures 510*a*, 510*b* (not shown in FIG. 2) and/or 510*c*, 510*d* are symmetric with respect to the spray axis 550.

Figure 5:
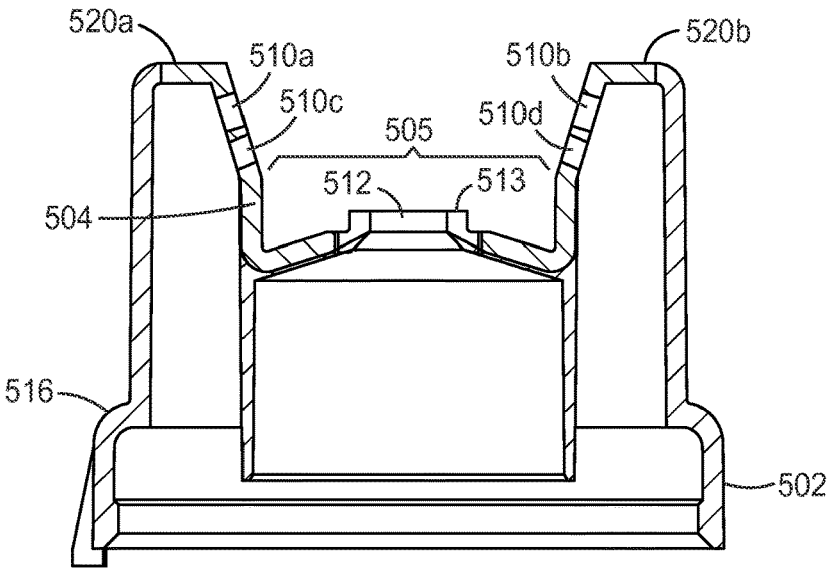
FIG. 5 is a cross-section view of the air cap of FIG. 2.
Figure 14:
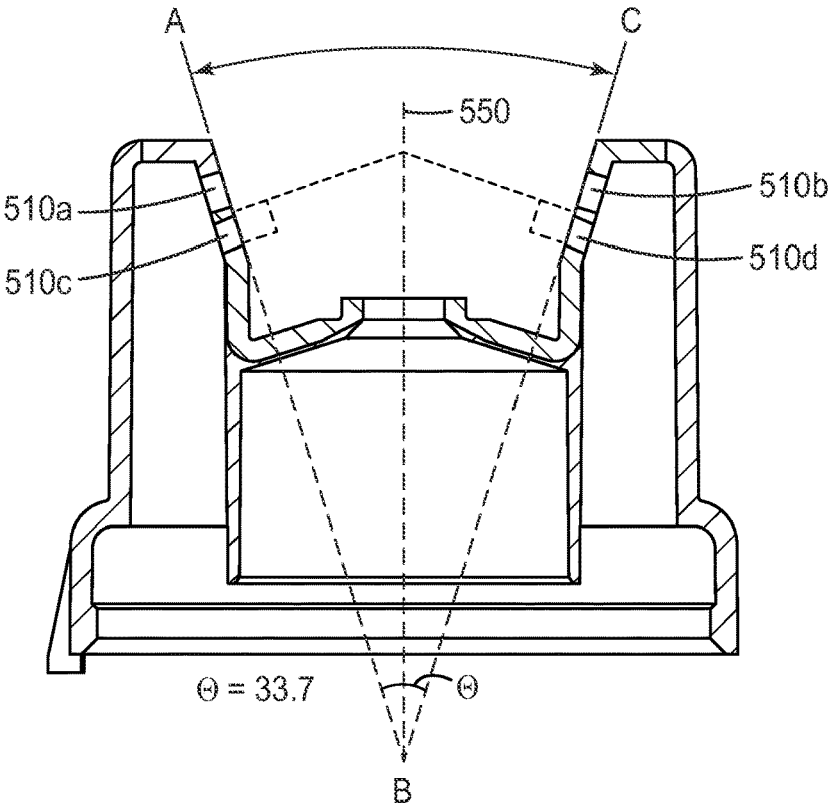
FIG. 14 is a version of the air cap of FIG. 5 with markings to show an exemplary alignment of features.

With respect to FIG. 14, provided is the air cap of FIG. 5 with markings to show an exemplary alignment of features. That is, the markings provide a way to determine included angles with respect to the spray axis 50 and one or both pairs of shaping air apertures 510*a* & 510*b* and/or 510*c* & 510*b*. An included angle Θ, which is defined by AB & BC (also may be referred to as angle ABC) may range from 25° to 85°. In the embodiment of FIG. 14, the included angle Θ is 33.7°. The pairs of apertures as shown in the non-limiting embodiment of FIG. 14 are slightly angled relative to one another and are of different diameters. Relation of the pairs of apertures can be designed as needed. In other embodiments, they may be parallel and/or the same diameter.

Figure 6:
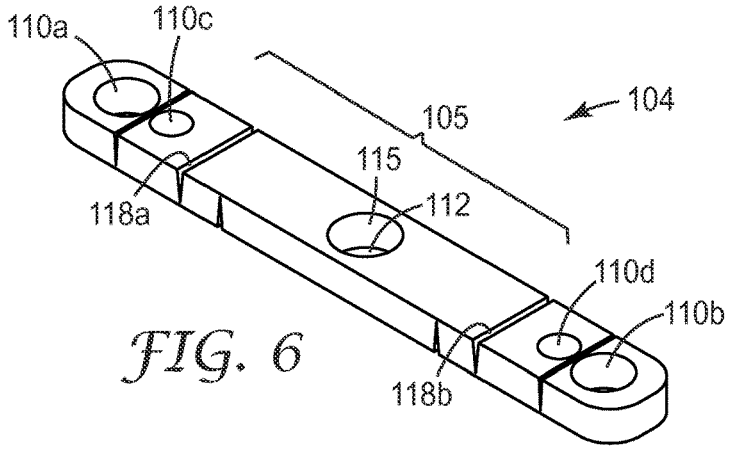
FIG. 6 is a perspective view of an exemplary face geometry insert.
Figure 7:
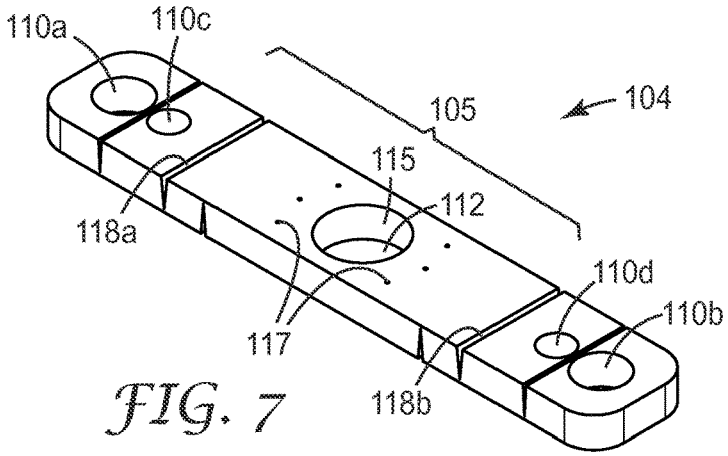
FIG. 7 is a perspective view of the face geometry insert of FIG. 6 further comprising auxiliary air holes.

FIG. 6 is a perspective view of an exemplary face geometry insert and FIG. 7 is a perspective view of the face geometry insert of FIG. 6 further comprising auxiliary air holes. Face geometry insert 104 is formed in a substantially flat configuration and has hinges 118*a*, 118*b* to permit shaping it to fit into a base member. The pairs of shaping air apertures 110*a*, 110*b* and 110*c*, 110*d* and the center frame opening 112 are aligned as a result of the mold design. Air flow surface 115 is shaped as desired. Optional auxiliary air holes 117 are located in the body of the face geometry insert 104. In combination with the pairs of holes 110*a*, 110*b* and 110*c*, 110*d*, air jets exiting the auxiliary air holes interact with the shaping air jets to shape and refine the liquid spray further in addition to the air exiting a center air outlet, which is the annulus between the air flow surface 115 and the outside surface or diameter of a liquid nozzle port. Additionally, the forwardly projecting air jets from the auxiliary air holes help prevent or reduce the accumulation of spray on the air cap that can be caused by the impinging flows in front of the air cap. Location of the auxiliary air holes is not limited, but usually they are arranged symmetrically about the center frame 513 or center frame opening 512.

Figure 8:
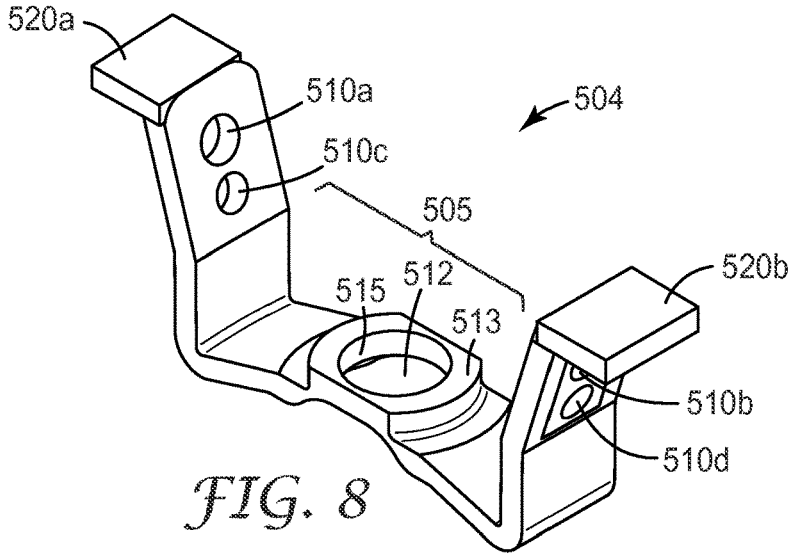
FIG. 8 is a perspective view of another exemplary face geometry insert.
Figure 9:
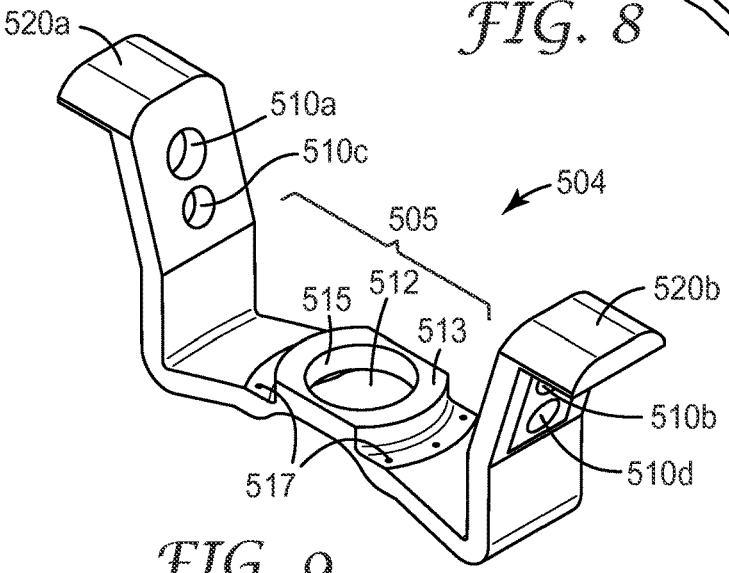
FIG. 9 is a perspective view of the face geometry insert of FIG. 8 further comprising auxiliary air holes.

FIG. 8 is a perspective view of another exemplary face geometry insert and FIG. 9 is a perspective view of the face geometry insert of FIG. 8 further comprising auxiliary air holes. Face geometry insert 504 may be formed in its final desired shape for fitting into a base member. The pairs of shaping air apertures 510*a*, 510*b* and 510*c*, 510*d* and the center frame opening 512 are aligned as a result of the mold design. Center frame 513 is present. Air flow surface 515 is shaped as desired. Capping features 520*a*, 520*b* facilitate assembly and/or registration of the face geometry insert 504 with respect to a base member. Optional auxiliary air holes 517 are located in the body of the face geometry insert 504. Air jets exiting the auxiliary air holes interact with the shaping air jets to shape and refine the liquid spray further in addition to the air exiting a center air outlet, which is the gap between the air flow surface 515 and the outside surface or diameter of a liquid nozzle port. Additionally, air jets from the auxiliary air holes help prevent or reduce the accumulation of spray on the air cap that can be caused by the turbulent air flow in front of the air cap. Location of the auxiliary air holes is not limited, but usually they are arranged symmetrically about the central frame opening.

Figure 10:
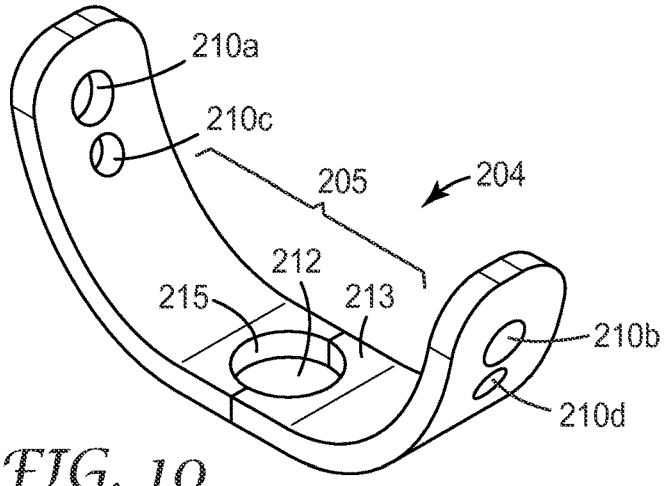
FIG. 10 is a perspective view of another exemplary face geometry insert.

FIG. 10 provides a perspective view of another exemplary face geometry insert 204 which may be formed in its final desired shape without hinges for fitting into a base member. The pairs of shaping air apertures 210*a*, 210*b* and 210*c*, 210*d* and the center frame opening 212 are aligned as a result of the mold design. Center frame 213 is present. Air flow surface 215 is shaped as desired.

Figure 11:
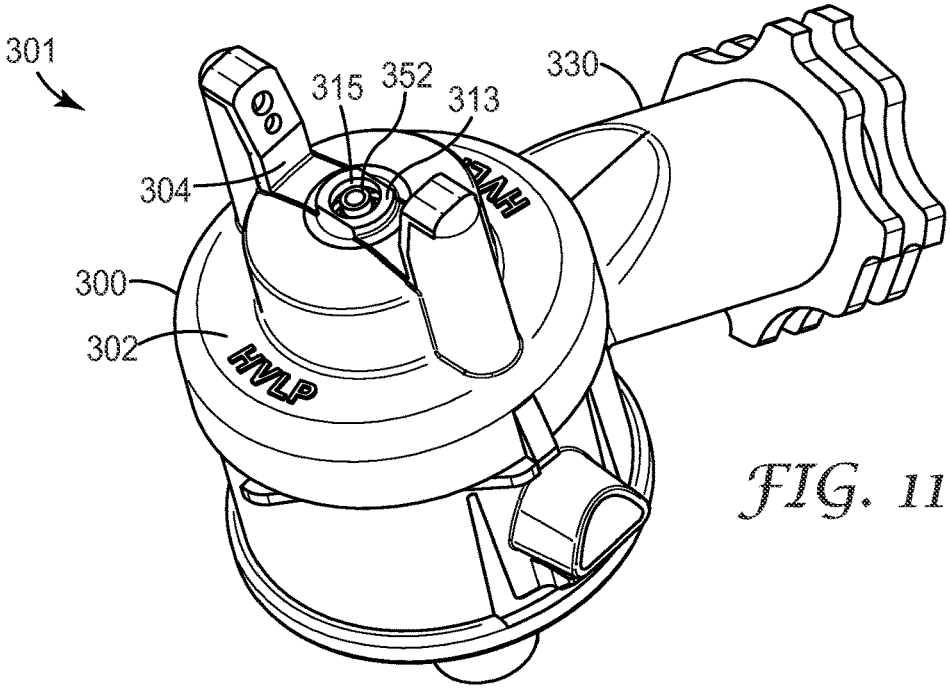
FIG. 11 is a perspective view of an exemplary spray head assembly.
Figure 12:
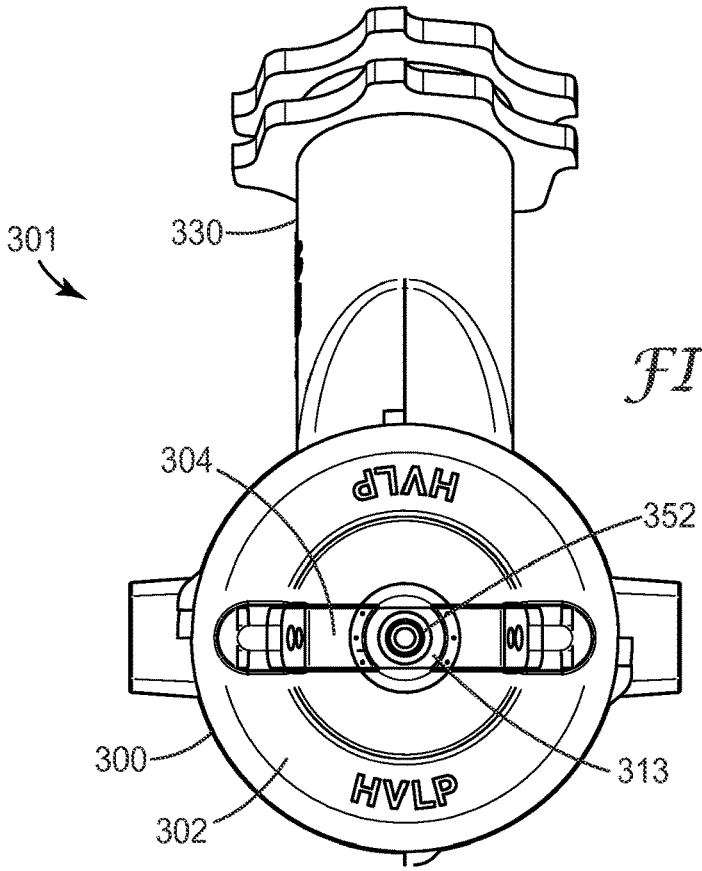
FIG. 12 is a top view of the spray head assembly of FIG. 11.
Figure 15:
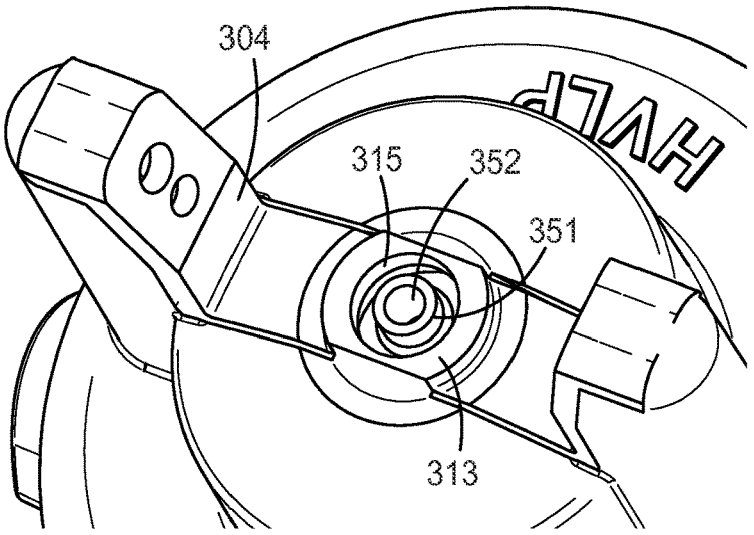
FIG. 15 is a close-up of FIG. 11.

FIG. 11 provides a perspective view of an exemplary spray head assembly, and FIG. 12 is a top view of FIG. 11. FIG. 15 is a close up of FIG. 11. Spray head assembly 301 has a barrel 330 to which the air cap 300 attaches. The air cap may have stops that limit rotation of the air cap on the barrel due to the presence of tabs or other such features on the barrel. This may permit rotation through a desired angle (e.g., 90 degrees) between first and second relative positions. The air cap 300 comprises face geometry insert 304 and base member 302. A liquid nozzle port 352 resides in the center frame opening (not numbered) defined by center frame 313. Air will flow through the annulus formed between the air flow surface 315 and the outside diameter 351 of the liquid nozzle port 352 during operation of a liquid spray gun. The air flow surface 315 may be designed in any angle, depth, shape, or otherwise to achieve a spray pattern suitable for a particular application.

Figure 16:
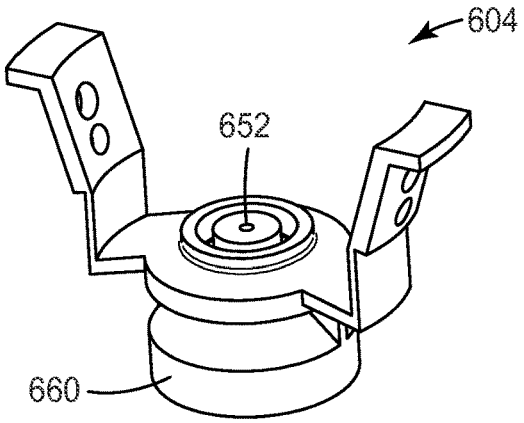
FIG. 16 is a perspective view of another exemplary face geometry insert with a nozzle tip attached.
Figure 17:
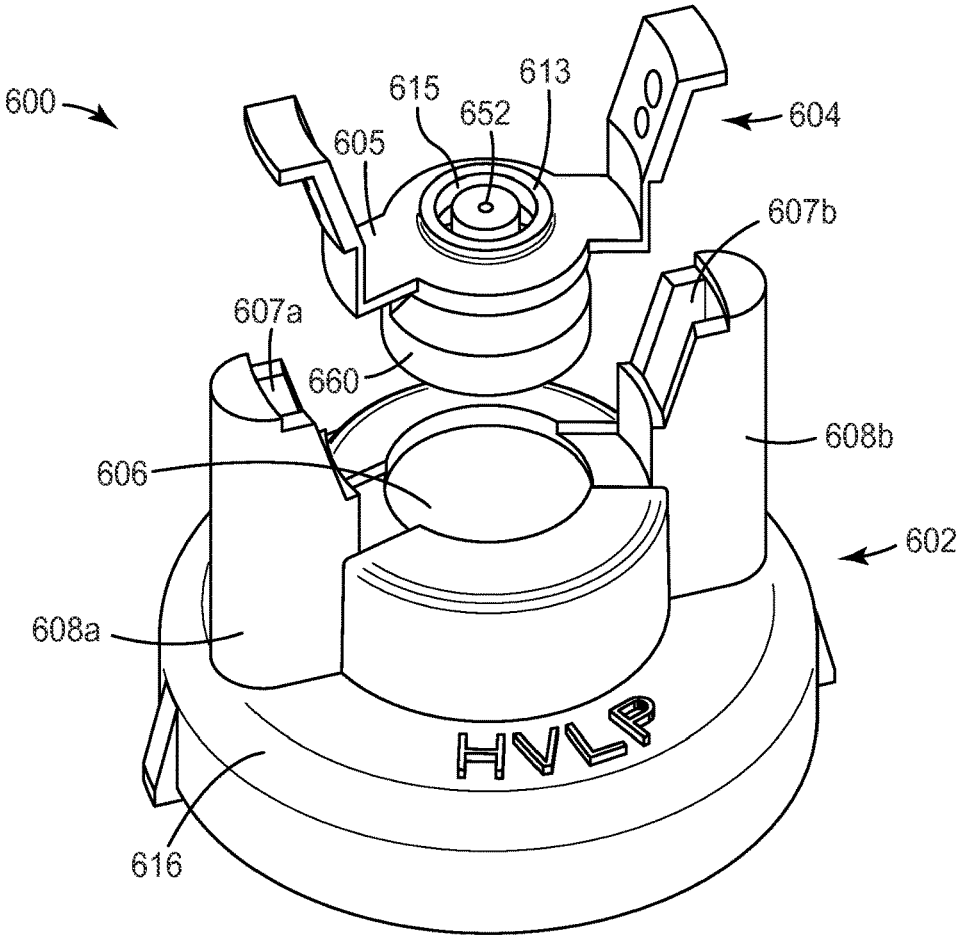
FIG. 17 is an exploded perspective view of an air cap according to an embodiment where a nozzle tip is attached to a face geometry insert.

Optionally, nozzle tips may be attached onto the liquid nozzle port 352 and/or face geometry insert 304. Exemplary nozzle tips are provided in WO2012/109298 (Joseph), commonly assigned and incorporated herein by reference. Positioning of the pair of shaping air apertures, the center frame opening, and the nozzle tip may be effective to provide a refined spray pattern from the liquid spray gun. In FIG. 16, a nozzle tip 660 is attached to face geometry insert 604. Liquid nozzle port 652 is also shown. FIG. 17 shows an exploded perspective view of an air cap 600 and the face geometry insert 604 with the nozzle tip 600 attached. The face geometry insert 604 comprises a bridging portion 605, one or more pairs of air apertures (not numbered) and is retained to the base member 602. The face geometry insert 604 may also comprise a center frame 113 and its center frame opening (not numbered) has nozzle tip 660 and nozzle port 652 residing therein. Air flows through the annulus formed by air flow surface 615 and the outside diameter of liquid nozzle port 652. The base member 602 comprises at least one pair of exit air openings 607*a*, 607*b*, a base member body 616, and a nozzle tip opening 606. Air horns 608*a* and 608*b* are exemplified in FIG. 17.

Figure 13:
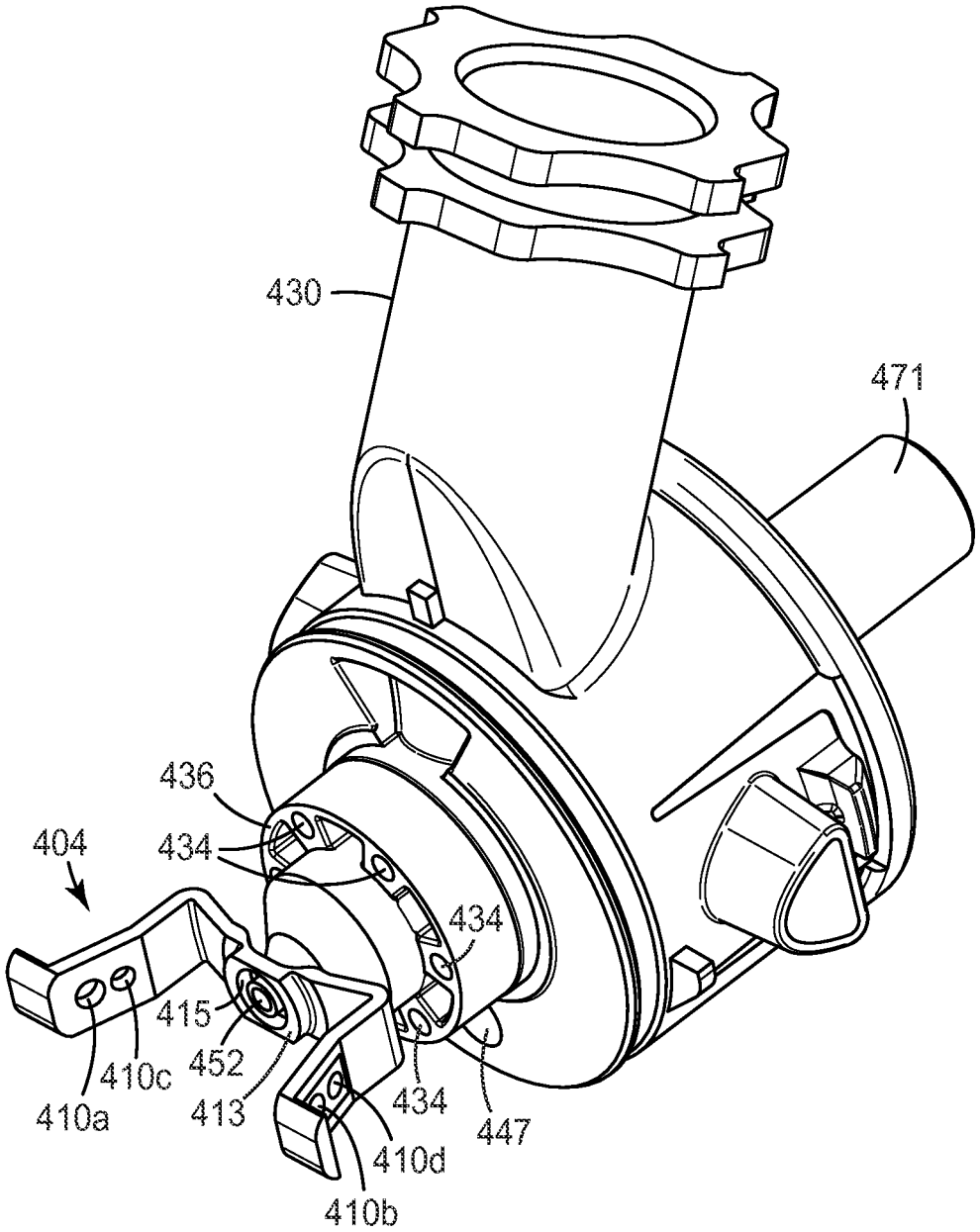
FIG. 13 is a perspective view of the spray head assembly of FIG. 11 with the base member removed to show detail of the barrel and face member insert 404.

FIG. 13 is a perspective view of the spray head assembly of FIG. 11 with the base member removed to show detail of the arrangement and position of the face geometry insert with respect to the liquid nozzle port of the barrel. Barrel 430 has a front wall 436 having openings 434, a fan air barrel passage 447, a liquid nozzle port 452, and liquid passageway 471. The face geometry insert 404 has shaping air apertures 410*a*, 410*b* (not shown), 410*c*, and 410*d*, center frame 413, and air flow surface 415. Liquid supplied by a reservoir of a spray gun travels through the liquid passageway 471 and out the liquid nozzle port 452. An air passageway from the spray gun supplies air through the openings 434 to a center air outlet (not numbered), which is the gap between the air flow surface 415 and the outside surface or diameter of the liquid nozzle port 452. Air also exits the shaping air apertures 410*a*, 410*c*, and 410*d* (aperture 410*b* is not shown) and the fan air barrel passage 447. The face geometry insert 404 permits the formation of a single molded piece that contains various exit openings whose sizes and positions can be precisely defined so that resulting spray patterns are reliably and consistently produced.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

What is claimed is:

1. An air cap for a liquid spray gun, the air cap comprising:

a base member comprising a base member body, at least one pair of air horns having at least one pair of exit air openings, and a nozzle tip opening; and a face geometry insert comprising a bridging portion and a pair of shaping air apertures and being retained to the base member body;

wherein each aperture of the pair of shaping air apertures is located on an opposite side of a spray axis of the air cap, and wherein the base member and face geometry insert are configured so that air exits the air cap through the at least one pair of shaping air apertures.

2. The air cap of claim 1, wherein each aperture of the pair of shaping air apertures is symmetric with respect to the spray axis.

3. The air cap of claim 1, wherein the face geometry insert further comprises a center frame opening such that the center frame opening is concentric with the nozzle tip opening.

4. The air cap of claim 1, wherein the face geometry insert further comprises at least one pair of capping features.

5. The air cap of claim 1, wherein the base member further comprises at least one pair of capping features.

6. The air cap of claim 1, wherein the face geometry insert further comprises at least one pair of auxiliary air holes.

7. The air cap of claim 1, wherein the face geometry insert is removable from the base member body.

8. The air cap of claim 7, wherein the face geometry insert snap-fits into the base member body.

9. The air cap of claim 7, wherein the face geometry insert bend-fits into the base member body.

10. The air cap of claim 1, wherein the face geometry insert is welded to the base member body.

11. The air cap of claim 1, wherein the face geometry insert comprises at least one hinge.

12. The air cap of claim 1, wherein the face geometry insert comprises a non-planar body and no hinges.

13. The air cap of claim 3 further comprising a nozzle tip affixed to the face geometry insert.

14. The air cap of claim 13, wherein the nozzle tip is removably affixed to the center frame of the face geometry insert.

15. The air cap of claim 13, wherein the nozzle tip is integral to the face geometry insert.

16. The air cap of claim 1, wherein an included angle Θ is in the range of 25° to 85°.

17. A kit comprising a plurality of air caps as recited in claim 1, wherein the pairs of shaping air apertures of at least two of the face geometry inserts have different configurations.

18. A kit comprising a plurality of air caps as recited in claim 1, wherein the center frame openings of at least two of the face geometry inserts have different dimensions.

19. A kit comprising a plurality of air caps as recited in claim 13, wherein the nozzle tips of at least two of the face geometry inserts have different dimensions.

* * * * *